United States Patent [19]

Wood et al.

[11] 4,196,071

[45] Apr. 1, 1980

[54] VENTILATED DIAPHRAGM SUPPORT FOR CHLOR-ALKALI CELL

[75] Inventors: Judson A. Wood, Charleston, Tenn.; Steven J. Specht, Mentor, Ohio

[73] Assignee: Olin Corporation, New Haven, Conn.

[21] Appl. No.: 14,020

[22] Filed: Feb. 22, 1979

[51] Int. Cl.[2] ..... C25B 9/00; C25B 13/02

[52] U.S. Cl. ..... 204/266; 204/279

[58] Field of Search ..... 204/263–266, 204/279

[56] References Cited

U.S. PATENT DOCUMENTS

| | | | |
|---|---|---|---|
| 3,980,544 | 9/1976 | Adams | 204/286 |
| 4,014,775 | 3/1977 | Kircher et al. | 204/266 X |
| 4,065,376 | 12/1977 | Whyte et al. | 204/263 |
| 4,110,191 | 8/1978 | Specht et al. | 204/266 |
| 4,115,237 | 9/1978 | Woodard, Jr. et al. | 204/266 X |

*Primary Examiner*—John H. Mack
*Assistant Examiner*—D. R. Valentine
*Attorney, Agent, or Firm*—Bruce E. Burdick; Thomas P. O'Day

[57] ABSTRACT

A perforated support for helping prevent damage to a non-adherent membrane in a chlorine gas-producing cell configuration having downwardly open, gas-trapping pockets adjacent such a membrane in the upper end of a chlorine-producing anolyte chamber. The cathode chamber can be at a greater pressure than the anode chamber to force the diaphragm against the support.

14 Claims, 12 Drawing Figures

VENTILATED DIAPHRAGM SUPPORT FOR CHLOR-ALKALI CELL

This invention relates to diaphragm-type electrolytic cells for the production of corrosive gases and particularly to a means for minimizing damage to the diaphragm or membrane of such diaphragm-type cell from such corrosive gases.

"Diaphragm-type" as used herein also includes the so called "membrane cells" which use ion exchange materials which are not permeable to hydraulic flow as are conventional diaphragm cells. Similarly, the terms "diaphragm" and "casing" as used herein include ion exchange membranes as well as conventional diaphragms, unless otherwise stated.

For years commercial diaphragm cells have been used for the production of chlorine and caustic soda which employed a deposited fiber diaphragm, usually asbestos. While quite satisfactory for producing chlorine, the caustic soda was of a relatively low concentration and contained considerable amounts of undesired sodium chloride.

Recently materials have been produced which may be employed as diaphragms to produce caustic soda of increased concentration while significantly reducing the sodium chloride content. These materials, having ion exchange properties, are produced from one or a combination of polymeric materials. The materials may be fabricated in the form of continuous glove-like fabricated sheets to extend over a group of electrodes. They may also be produced in the form of a casing which is attached to individual electrodes or even flat sheets, one of which is held between each pair of opposed electrodes, such as for example in a filter press cell like that of Whyte et al. U.S. Pat. No. 4,065,376 issued Dec. 27, 1977. It is important that the attachment of the fabricated diaphragms be accomplished in a manner which will sealingly attach the diaphragm to the cell housing to prevent undesired leakage into or out of the electrode compartment or between compartments. Leakage between anode and cathode compartments along diaphragm seams or seals can result in a substantial reduction in current efficiency by allowing back migration of hydroxyl ions from catholyte to anolyte and flow of NaCl from anolyte to catholyte.

It is known in the prior art to attach fabricated diaphragms, for example, by means of clamps or expansible retainers. U.S. Pat. No. 1,797,377 employs clamps having offset claws which straddle two ends of the diaphragm covered electrode, pinching them together and pressing the edges between the clamp and a support plate. This method does not effectively seal the area across the top of the electrodes and requires the diaphragm be separately clamped to each electrode with no cooperation between adjoining clamps and it is too complex and cumbersome to be of much use in the typical chlor-alkali production cell.

Flexible retainers are employed to secure a diaphragm in U.S. Pat. No. 3,878,082 where a U-shaped compressible retainer is used in combination with a crescent-shaped expansible retainer. The crescent-shaped retainer is placed over the diaphragm in the area between adjacent cathodes so that one end extends over a portion of one cathode and the other end covers a portion of the adjacent cathode. The U-shaped retainer is placed on top of the cathode so that it clamps down over one end each of two adjacent crescent-shaped retainers. This method has been found to effectively sealingly attach the diaphragm or membrane to the cell housing, but is also fairly complex due to the number of parts required.

U.S. Pat. No. 3,980,544 discloses securing a fabricated diaphragm covering electrodes using clamps which seal an adjoining edge of each of two adjacent diaphragms. The clamps are thus positioned between adjacent electrodes, with a pair of clamps being required for each electrode. While the clamps satisfactorily seal the open ends of the diaphragm, it is desirable to improve the ease of sealing the diaphragm along the top and bottom edges, especially the top edge.

Another approach is to use a more complex diaphragm structure, such as the tabbed, envelope-shaped diaphragm or membrane structure in order to allow clamping by a single perimeter frame, preferably a rectangular frame. This method makes the clamp so much simpler that it can be of practical use in production chlor-alkali cells and is useful with diaphragms that can be easily fabricated into the necessary shapes. However, it was discovered that although the complex diaphragm-rectangular frame clamp assembly was a major improvement structurally and sealingly attached the membrane to an anode backplate, the cell with such a membrane attachment unexpectedly had a shorter than desired "life" or period of maximum cell efficiency. It was thus desired to locate the cause of this unexpected problem and provide a solution. Similar problems are believed to be present in certain filter press cell designs based upon analysis of such cells.

Therefore, it is an object of the invention to give a longer "life" to cells which generate gases and especially corrosive gases and have a structure which tends to trap gas in restricted flow pockets adjacent the membrane.

It is a further object of the present invention to provide a cell with a relatively long useful life having a casing for enclosing an electrode which provides a perimeter in the form of a flat plate.

Another object of the present invention is to provide a casing attachment system for positioning the casing in such a manner as to increase casing life and for enclosing an electrode which allows the use of simplified methods of clamping.

A solution to these and other problems and objects is the present invention which provides, in a diaphragm-type cell for the production of alkali metal hydroxide and chlorine gas from an aqueous solution of alkali metal chloride having a cell housing defining an anode chamber and a cathode chamber, a diaphragm separating said cathode chamber from said anode chamber, a chlorine outlet in fluid communication with said anode chamber and a clamp for attaching said diaphragm to said housing, said diaphragm being attached at its upper end to and extending downwardly from said cell housing, the improvement comprising:

(a) a support member, projecting downwardly from and spaced inward from said cell housing, for loosely underlying and supporting at least a portion of said downwardly extending diaphragm, and (b) ventilation passageway means, separate from and in addition to said chlorine outlet and passing through said support member at a point lower than said chlorine outlet, for allowing liquid-gas, two phase flow between said support member and said diaphragm, so as to allow continual contact of said portion of said diaphragm with liquid.

The invention will be better understood by referring to the accompanying drawing which includes FIGS. 1–12 illustrating a preferred embodiment of the present invention. Corresponding parts have the same numbers in all Figures.

Figure 1:
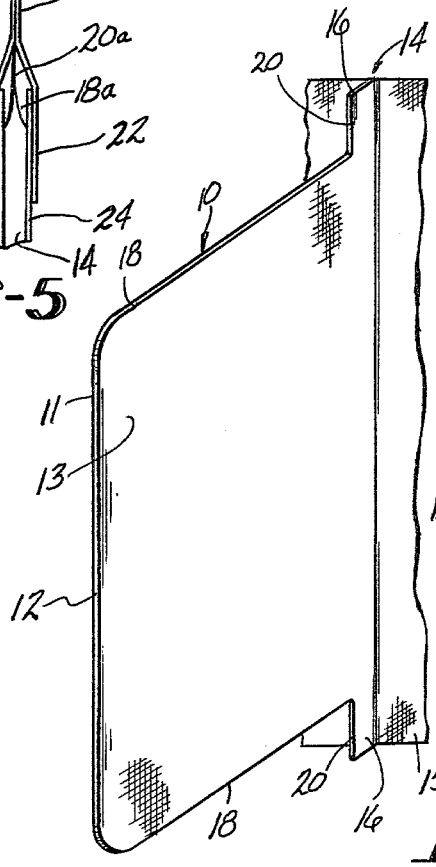
FIG. 1 represents a side view in perspective of one embodiment of a diaphragm casing which can be used with the present invention.
Figure 2:
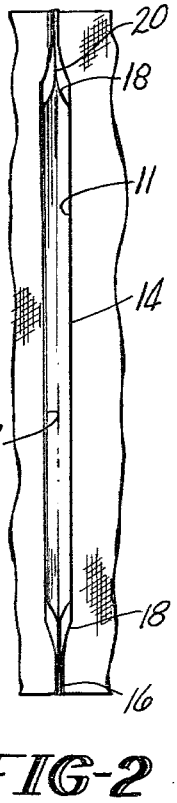
FIG. 2 illustrates a rear view of the diaphragm casing of FIG. 1.
Figure 3:
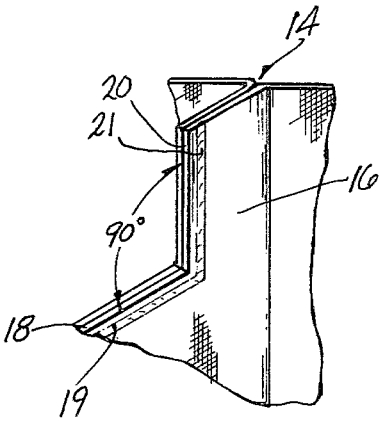
FIG. 3 shows details of one tab on the diaphragm casing of FIG. 1.

FIGS. 1–3 illustrate a casing 10 which may be used in one embodiment of the present invention. Diaphragm casing 10 is made of a flexible material and has a front closed end 12, two sidewall sheets 11 and 13 and an open rear end 14. Two tabs 16 extend from the upper and lower edges of sheets 11 and 13 adjacent open end 14. Transition regions 15 are provided to sealingly connect adjacent casings to each other and to a cell housing for support. Open ends 14 can be connected to transition regions 15 by forming sheets 11 and 13 integral with regions 15. Sheets 11 and 13 are connected at their top and bottom at closed edges 18. Closed edges 18 are formed by providing substantially linear seals 19 which terminate at tabs 16. Tabs 16 are sealed along their front edges 20 adjacent to closed edges 18 by providing a heat seal 21 which is at an angle to heat seals 19. Seals 19 and 21 are preferably heat sealed portions of sheets 11 and 13 or tabs 16 rather than a separate piece of material. Thus seals 19 and 21 in FIG. 3 appear as the indented areas where heat sealing of sheet 11 to sheet 13 has occurred. For the embodiment of FIGS. 1–3, the preferred external angle between seals 19 and 21 is about 90°, as best illustrated in FIG. 3.

Figure 4:
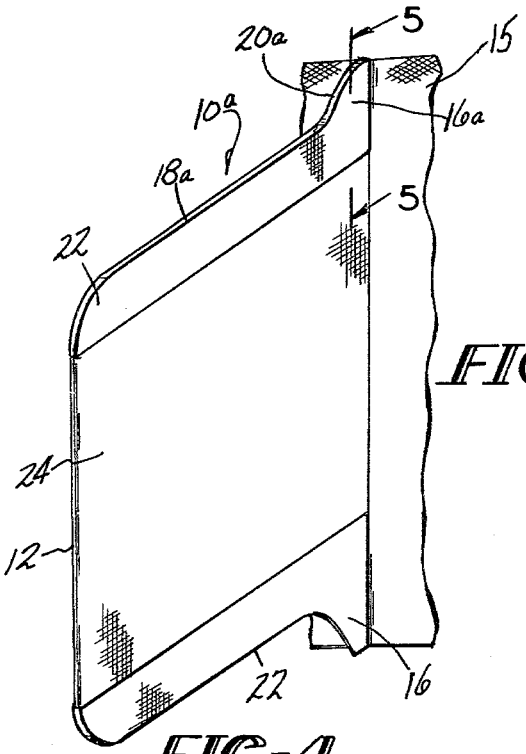
FIG. 4 depicts a side view in perspective of another casing which can be used with the present invention.
Figure 5:
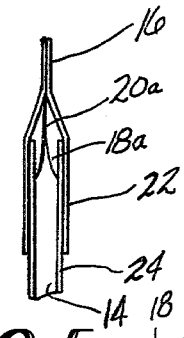
FIG. 5 represents a rear view of a partial section of the diaphragm casing of FIG. 4.

FIGS. 4 and 5 show a modified casing **10*a* of the present invention with stronger edges and tapered tabs 16*a*. Casing 10*a* is formed by partially overlapping and seam welding border sections 22 to the top and bottom of a central section 24 where different materials are employed for the border sections and the central section. Preferably, border section 22 is chosen for strength and sealability, while central section 24 is chosen for its ion exchange characteristics. Closed edges 18*a* and tabs 16*a* with edge 20*a* are formed on the border section, the external angle between edges 18*a* and seal 20*a*** being greater than 90°.

Figure 6:
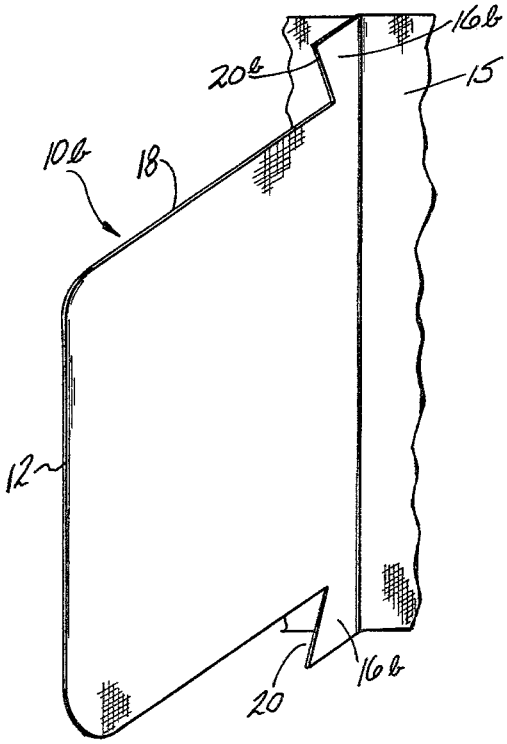
FIG. 6 illustrates a side view in perspective of an additional diaphragm casing which can be used with the present invention.

FIG. 6 represents another modified casing **10*b* with modified tabs 16*b*. For casing 10*b*, the external angle between the edges 20*b* of tabs 16*b* and closed edges 18** is less than 90°.

Figure 7:
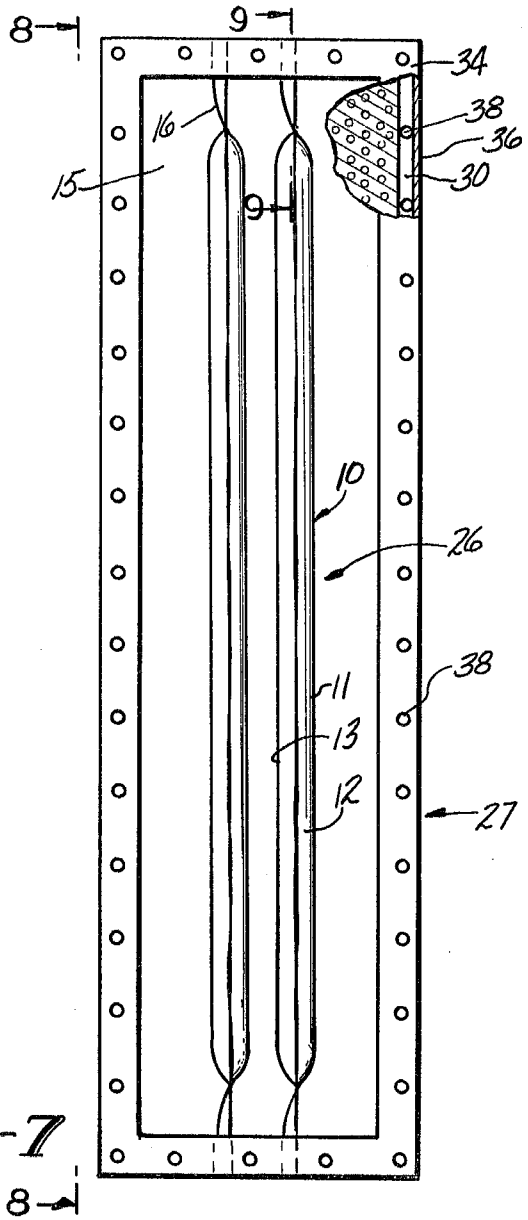
FIG. 7 illustrates a front exterior end view of a pair of electrodes covered by a diaphragm casing and attached by a preferred clamping system embodying one form of the present invention.
Figure 8:
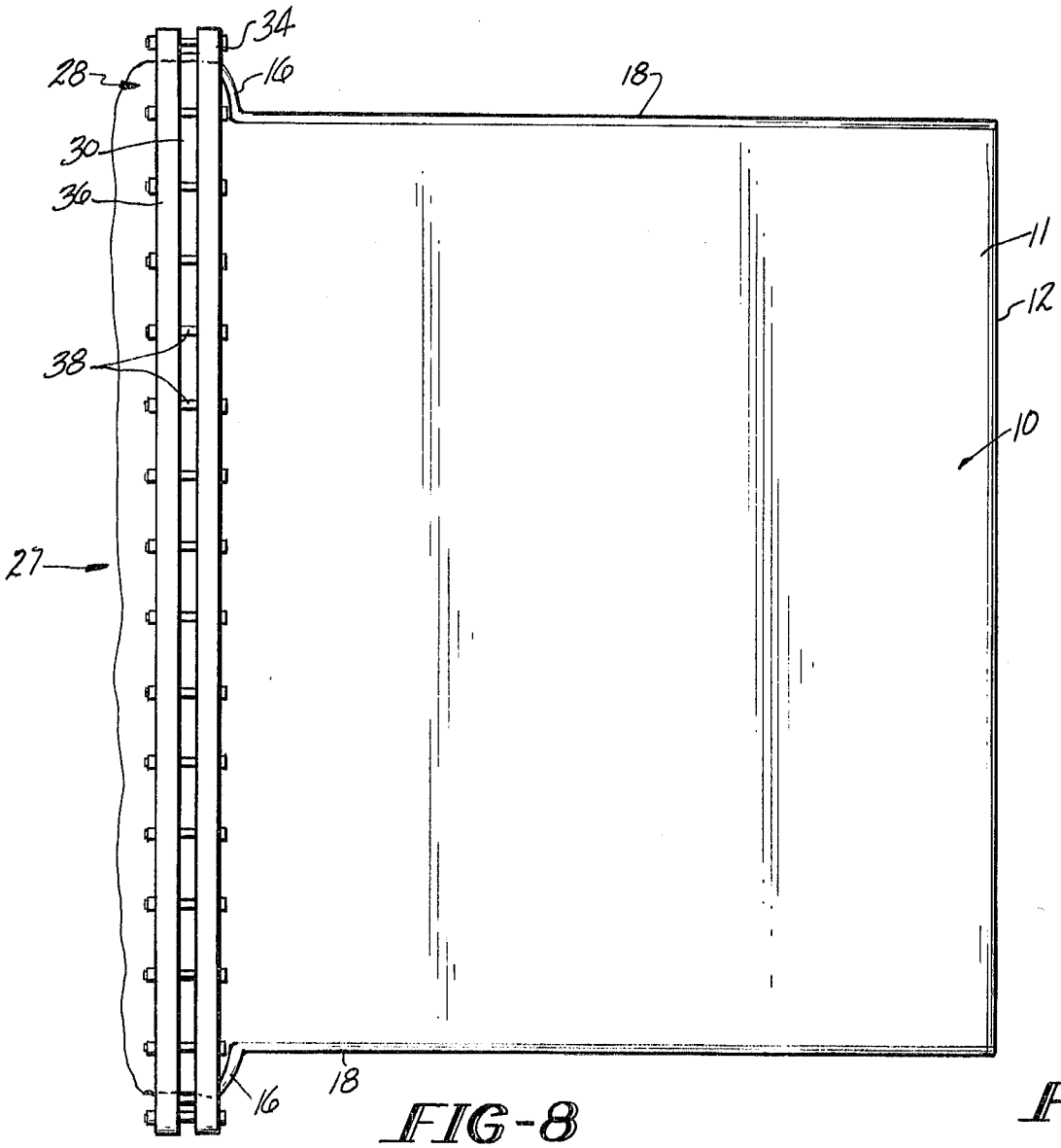
FIG. 8 represents a vertical, cross-sectional, side view through a cell showing one electrode of FIG. 7 along line 8—8.
Figure 9:
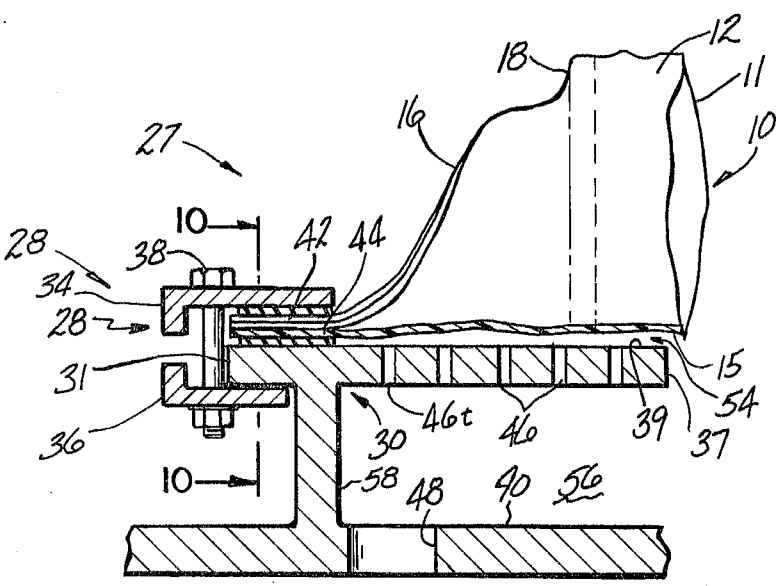
FIG. 9 illustrates a partial vertical side section of FIG. 7 taken along line 9—9 but modified to show a diaphragm casing attachment assembly of the invention in which a T-shaped clamping flange is used.
Figure 10:
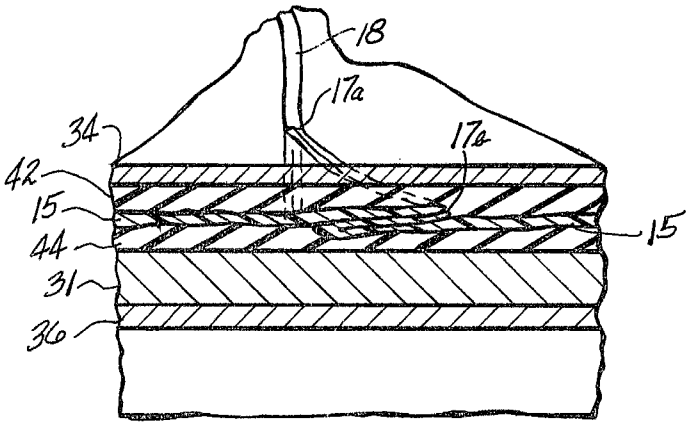
FIG. 10 is a top, horizontal, cross-section view through the clamping assembly of FIG. 9 taken along line 10—10.

FIG. 7 is a front view and FIG. 8 is a side view of a pair of casings 10 enclosing a pair of electrodes on all but the rear side. The electrodes cannot be seen in FIG. 7 or FIG. 8, since the electrodes are enclosed by casings 10 which have a closed front end 12. An attachment assembly 27 connects casing 10 to a backplate 40 (see FIG. 9 or 11) which can be of any conventional design, such as a disc or rectangular plate or other shape. Attachment assembly 27, which is shown in greater detail in FIGS. 9–10, comprises inner portion 34, an inner gasket 42, an outer gasket 44, clamping flange 30, outer portion 36 and a plurality of bolts 38. Tabs 16 are twisted and are covered in part by a frame-like perimeter clamp 28 which forms a part of assembly 27. Clamp 28, as illustrated in FIGS. 9 and 10, comprises inner portion 34, outer portion 36 and bolts 38. Portions 34 and 36 are held together by bolts 38. Bolts 38 are tightened so that clamp 28 holds and seals tabs 16 against a ventilated clamping flange 30 (described below) projecting from backplate 40. A cutaway view shows clamping flange 30 to be partially perforated for ventilation purposes described below. "Clamp" is used broadly herein to refer to a device which squeezes or presses two or more parts together so as to hold them firmly and thus includes filter press attachments.

While flange 30 is a rectangular frame of T-shaped cross-section with the base 58 of the T welded or otherwise attached to backplate 40 and projecting perpendicularly inward therefrom, other shapes of ventilated flanges could be used. Tabs 16 are twisted forwardly or rearwardly 90° until they in part lie parallel to backplate 40 and against the inner surface 39 of an inner lip 37 of flange 30. Inner lip 37 is the perforated right part of flange 30 as seen in FIG. 9. Inner lip 37 underlies transition regions 15.

FIG. 9 is a vertical cross-section through attachment assembly 27 of FIG. 7. Clamping assembly 27 comprises a clamping flange 30, clamp 28, gaskets 42 and 44 and support lip 37. Clamping flange 30 is preferably attached to anode backplate 40 adjacent chlorine outlet 48. Gas, liquid-gas foam or gas-containing liquid is collected in the space 56 between lip 37 and backplate 40 and flows to outlet 48 and is thus removed from the cell as a product of electrolysis. A suitable disengager (not shown) may be used to separate gas and liquid phases, with the liquid being returned to the cell. As noted above, clamping flange 30 is a T-shaped bar frame projecting inwardly from backplate 40, with the base of the T attached to backplate 40 although other shapes could also be used. The perforated support lip 37 serves as a support member to underly and support transition region 15 of casing 10 which extends downwardly from assembly 27 to edge 18. Tab 16 is twisted about 90° so that its upper end is vertical and lies against the vertical upper end of transition region 15. Tab 16 is held in this twisted position by gasket 42 which presses against tab 16 and gasket 44 which presses against transition region 15. Gaskets 42 and 44 and the upper ends of tab 16 and transition region 15 are clamped between portion 34 and upper lip 31 of clamping flange 30 by bolt 38. However, as noted above, an unexpected number of pinholes were found to develop in region 15 until lip 37 was perforated according to the present invention. In this position, region 15 is only loosely supported by lip 37 and there was unexpectedly determined to be a tendency for gas, e.g. chlorine, generated by electrolysis to accumulate in the space 54 between the inner surface 39 of lip 37 and the anodic side of region 15. As a significant part of the invention, the deterioration of region 15 was determined to be caused by chemical attack and drying out of region 15 rather than physical stresses as would normally be thought in a clamping region. This accumulated gas under region 15 is unexpectedly found to dry and chemically attack region 15. Therefore, a multiplicity of gas ventilation perforations 46 are made in lip 37 from space 54 to space 56 to ventilate and allow liquid-gas two phase flow through space 54 so as to keep region 15 wet. When chlorine outlet 48 is under a "vacuum" negative gauge pressure, as is the case in many conventional cells, perforations 46 help region 15 to be pushed by the higher pressure in the cathode chamber against surface 39 and thus give increased resistance to both gas accumulation in and gas or liquid flow through space 54 and reduce the volume of space 54. Whether or not the chlorine outlet is at a negative gauge pressure, if the cathode chamber is filled to a higher level with catholyte than the anode chamber is with anolyte, a pressure differential or "catholyte head" will be created and will force region 15 against lip 37. If plate 37 is not perforated, this pressure may tend to trap gas under region 15 and prevent liquid from flowing into space 54 thus drying and chemically damaging region 15. Also, the bottom edges of gaskets 42 and 44, especially gasket 44, are located approximately even in height with the upper edge of the uppermost perforation **46*t* so that only a negligible gas pocket, if any, will remain above perforation 46*t* and so that gas flow through perforation 46*t*** will keep any such negligible pocket well circulated.

FIG. 10 is a horizontal cross-section looking downward through attachment assembly 27 of FIGS. 7–9 showing tab 16 twisted from a vertical orientation parallel to edge 18 at the end **17*a* near edge 18 to a vertical position perpendicular to edge 18 at the upper end 17*b* of tab 16. Upper end 17*b* lies against region 15 and as noted above is held between gasket 42 and 44 which are in turn held by portion 34 and upper lip 31 and portion 36. Portions 34 and 36 are held together by bolts 38 (see FIG. 9**).

Figure 11:
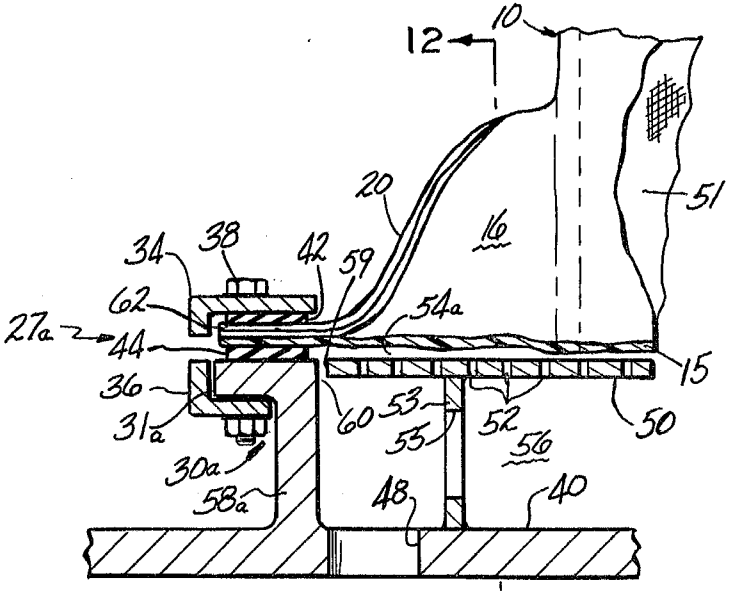
FIG. 11 is a partial vertical side section taken along line 9—9 of FIG. 7 except, unlike FIG. 7 or FIG. 9, modified to show the preferred diaphragm casing attachment assembly of the invention.

FIG. 11 is a modified form **27*a* of the assembly 27 of FIG. 9. Support lip 37 is omitted and a perforated support plate 50 substituted therefor. Assembly 27*a* comprises an L-shaped clamping flange 30*a* with a vertical upper lip 31*a* and a horizontal base 58*a*. Base 58*a* lies horizontal and connects lip 31*a* to vertical backplate 40. The upper end 59 of plate 50 is downwardly spaced from the horizontal base 58*a* of flange 30*a* so as to define a gas passageway 60 between base 58*a* and end 59. Plate 50 is provided with perforations 52 from space 54*a* to space 56. Perforations 52 correspond to perforations 46 of lip 37. Plate 50 is attached to backplate 40 by a perforated plate 53 having a vertical opening 55 therethrough so as to not restrict upward flow through space 56 to chlorine outlet 48. Plate 53 is preferably perpendicular to plate 50 and backplate 40 and thus parallel with base 58*a*. Plate 50 is preferably a titanium plate and can be in electrical contact with a current source so that plate 50 serves as a gas-evolving anode and thus makes effective use of the transition region 15 of the membrane. In fact, it is most preferred to have support plate 50 be made of the same foraminous mesh material, such as for example $TiO_2$—$RuO_2$ mixed crystal coated (Beers coating) titanium mesh, as anode 51 or even be a part of anode 51. In such a case, plate 50 would have literally thousands of perforations 52. A corresponding cathode could be positioned on the opposite side of region 15 from plate 50 and in conforming structure to plate 50 and region 15 to assist in this regard. In support plate 50, as with perforated support lip 37, described above, the number of the multiplicity of gas ventilation perforations 46 can vary from one to thousands depending on the size and shape of perforations 46. However, there must be a sufficient total cross-sectional area of perforations 52 to allow escape of gas at a rate equal to or greater than the rate at which gas enters or is generated within space 54*a*. Also, perforations 52 should be spread evenly so that all portions of space 54*a*** are adequately ventilated.

As an additional alternative (not shown), plate 50 can be an upward projection from an electrode 51 within casing 10, as for example by attachment to the closest side ("backside") of the electrode to backplate 40 or by attachment by welds or clamps to the conductor rods (not shown) supporting electrode 51. Also, backplate 40 and flange 30 or **30*a* could be lined with a rubber lining or other corrosion resistant lining, preferably an insulative lining. This lining could lie between flange 30 or 30*a* and backplate 40 so as to prevent flange 30 or 30*a*** from itself being an active electrode.

Figure 12:
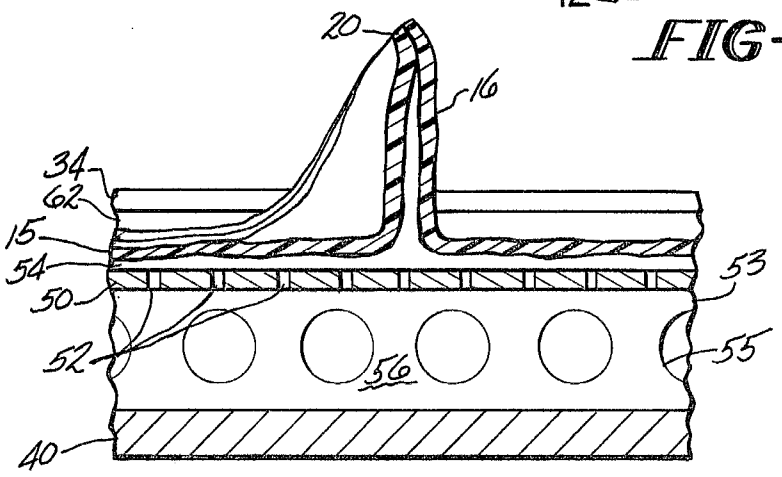
FIG. 12 is a vertical upward cross-sectional view of the transition region of FIG. 11 taken along line 12—12.

FIG. 12 is a horizontal cross-section looking upward through plate 50, transition region 15 and tab 16 and showing plate 53. Tab 16 is seen to be oriented generally vertical and generally perpendicular to backplate 40, with its upper end 62 twisted into a vertical position against region 15 where it is held by clamp portion 34. Perforated plate 50 separates and allows communication between spaces 54 and 56 through perforations 52 to ventilate space 54. Plate 53 attaches plate 50 to backplate 40 and has perforations 55 so as to allow substantially free flow upward through space 56.

While the preferred embodiment is a monopolar type cell with electrodes cantilevered from opposed cathode and anode backplates, the invention can be utilized in any similar clamping geometry whether in monopolar, bipolar, filter press or other design cells where restricted flow is otherwise a problem.

The novel casing of the present invention is comprised of a material which can be used as a porous diaphragm or an ion exchange membrane in an electrolytic cell of the diaphragm type. Suitable materials include sheets or fabrics of inorganic materials such as asbestos, and ion exchange resins such as the perfluorosulfonic acid and perfluorocarboxylic acid resins sold or being developed by E. I. DuPont de Nemours and Co. under the trademark "Nafion" as well as cross-linked vinyl imidazole polymers or copolymers such as those described in U.S. Pat. No. 3,935,086, issued to T. Misumi and S. Tsushima. The material should be flexible and capable of being sealed, for example, by means such as heat sealing, sewing, ultrasonic welding or by the application of sealants or some combination of such means.

Preferred materials for the casings of the present invention are perfluorosulfonic acid resins comprised of copolymers of a perfluoroolefin and a fluorosulfonated perfluorovinyl ether. Suitable perfluoroolefins include tetrafluoroethylene, hexafluoropropylene, octafluorobutylene and higher homologues. Preferred perfluoroolefins include tetrafluoroethylene and hexafluoropropylene, with tetrafluoroethylene being particularly preferred. The fluorosulfonated perfluorovinyl ethers are compounds of the formula $FSO_2CFRCF_2O[CFYCF_2O]_nCF{=}CF_2$ (I), where R is a radical selected from the group consisting of fluorine and perfluoroalkyl radical having from 1 to about 8 carbon atoms, Y is a radical selected from the group consisting of fluorine and trifluoromethyl radicals; and n is an integer of 0 to about 3. Illustrative of such fluorosulfonated perfluorovinyl ethers are:

$FSO_2CF_2CF_2OCF{=}CF_2$, $FSO_2CF_2CF_2OCF(CF_3)CF_2OCF(CF_3)CF_2OCF{=}CF_2$, $FSO_2CF_2CF_2CF_2CF_2OCF(CF_3)CF_2OCF{=}CF_2$, and $FSO_2CF_2CF_2OCF(CF_3)CF_2OCF{=}CF_2$.

Preferred sulfonated perfluorovinyl ethers are those of formula I above in which R is fluorine and Y is trifluoromethyl.

A particularly preferred sulfonated perfluorovinyl ether is that of the formula:

$FSO_2CF_2CF_2OCF(CF_3)CF_2OCF{=}CF_2$, perfluoro [2-(2-fluorosulfonylethoxy)propyl vinyl ether].

The sulfonated perfluorovinyl ethers can be prepared by methods described in U.S. Pat. Nos. 3,041,317 to Gibbs et al.; 3,282,875 to Connolly et al.; 3,560,568 to Resnick, and 3,718,627 to Grot.

The copolymers employed in the cationic permselective membrane of the present invention are prepared by methods described in U.S. Pat. Nos. 3,041,317 to Gibbs et al.; 3,282,875 to Connolly et al., and 3,692,569 to Grot and marketed by E. I. duPont de Nemous & Co. under the trademark NAFION ®.

The solid fluorocarbon polymers are prepared by copolymerizing the perfluoroolefin, for example, tetrafluoroethylene with the sulfonated perfluorovinyl ether followed by converting the $FSO_2$ group to $SO_3H$ or a sulfonate group (such as an alkali metal sulfonate) or a mixture thereof. The equivalent weight of the perfluorocarbon copolymer ranges from about 900 to about 1600, and preferably from about 1100 to about 1500. The equivalent weight is defined as the average molecular weight per sulfonyl group.

One particularly preferred casing material are the cation exchange membranes using a carboxyl group as the ion exchange controlling group and having an ion exchange capacity of 0.5–2.0 mEq/g of dry resin as disclosed in U.S. Pat. No. 4,065,366, issued Dec. 27, 1977 to Asahi Glass Kabushiki Gaisha, with Oda et al. as inventors.

Casings of the present invention preferably have a closed end, an open end, and two closed sides as above noted. At least one closed side has a tab portion which is adjacent to the open end. The tab is flexible and can be turned or twisted to provide a substantially flat surface on which clamping means can be used to effectively seal the casings along the upper and lower edges.

The closed end of the casing may be formed by folding a section of the material or by appropriately sealing two sections of material. A major portion of the closed sides has a substantially linear seal. A tab portion has a seal which is angular to the seal on the major portion. In addition, the seal on the tab portion is contiguous with the seal on the major portion so that the casing is leakproof along the sides. As illustrated in FIGS. 1, 3–4 and 6, the angle on the seal on the tab is any suitable one, for example, an external angle of from about 60° to about 120°, preferably from about 80° to about 100°. The internal angle is thus from about 300° to about 240°, and preferably from about 280° to about 260°. As illustrated in FIG. 3, the external angle is measured from a line which passes through or is parallel to the substantially linear seal along the major portion of the closed sides. The length of the tab portion is any suitable one which will provide a tab which can be twisted or turned so as to provide a substantially flat surface for sealing purposes. For example, tab portions which have a length of from about 1 to about 8, and preferably from about 2 to about 6 inches are satisfactory. Any suitable width may be used for the tab portions.

To provide a casing with suitable properties as a separator and also with suitable mechanical properties, it may be desirable, as shown in the embodiment illustrated in FIG. 4, to employ two different materials in forming the casing. The central section, which serves primarily as the separator during electrolysis has attached along at least one edge a strip of material having desirable sealing properties and mechanical properties. The strip or border section forms the closed side including the tab and is attached to the central portion by lamination, heat sealing (see FIGS. 4–5) or other conventional sealing procedures. Each strip is then sealed to a similar border section to form a closed edge, the seal preferably being linear along the major portion of the side and angular along the tab portion. The tab can be pre-cut or its portion can be formed by cutting the material along the outside of the angular seal to separate the major portion from the tab portion.

While it is preferred to have a tab portion on each of the closed edges, a suitable seal can be obtained by providing a tab on one closed side and sealing the other closed side, for example, by the clamping method described in U.S. Pat. No. 3,980,544, issued to J. O. Adams, K. E. Woodard, Jr. and S. J. Specht.

The plural-envelope or glove-like casing is attached by clamping to flange 30 in the preferred embodiment as noted above. However, as noted previously, the invention may find utility in filter press cells or other designs as well where gas flow restrictions are present adjacent the membrane due to similar clamping geometry.

While the invention has been illustratively described in terms of a preferred embodiment, it will be understood that minor variations are possible within the scope of the invention as defined in the claims.

The present invention is further illustrated by the following examples.

EXAMPLE 1

Two sheets 11 and 13 of a perfluorosulfonic acid membrane material (E. I. DuPont de Nemours' NAFION ® 391) are cut to provide a tab 16 as illustrated in FIG. 1. NAFION ® 391 is a homogeneous film 1.5 mils thick of 1500 equivalent weight perfluorosulfonic acid resin and a homogeneous film 5 mils thick of 1100 equivalent weight perfluorosulfonic acid resin laminated with a T-12 fabric of polytetrafluoroethylene. The outer edges of each of the two sheets are joined by heat sealing at a temperature of 230° C., a pressure of 3.0 $Kg/cm^2$ and a dwell time of 4.5 seconds on a thermal impulse heat sealing machine (Vertrod, Inc., Brooklyn, N.Y.) to form a closed end 12. The sheets are then sealed by seal 19 linearly along each side to form closed edges 18 up to the edge of the tab using the same heat sealing conditions as above. Heat seal 21 is then applied to the tab portion at an angle of about 90° from the linear seal along each side to complete casing 10. Seal 21 is applied so that it interconnects with seal 19 along the major portion of the side edge. The tab portion 16 is approximately 3 inches long. The casing is installed on an anode used in a cell for the electrolysis of sodium chloride in the production of chlorine and sodium hydroxide. To provide a flat surface for sealing the casing along the top and bottom edges, the tabs are twisted and a clamp applied, as shown in FIG. 11. The clamp assembly includes a titanium mesh support plate having thousands of gas ventilation passageways therethrough. During electrolysis, the casing is found to be leak-proof during tests in excess of 16 weeks and expanded or contracted with changes in cell operating conditions without placing a detrimental mechanical stress on the separator material.

COMPARISON EXAMPLE

Another casing 10 identical to the above NAFION 391 casing was fabricated by the same procedure but was instead attached to a similar anode backplate by the attachment assembly 27 of FIG. 9, except that perforations 46 were deleted so that a restricted flow gas pocket was created between flange 30 and transition 15. The cell was operated for 16 weeks to produce chlorine gas within casing 10. At the end of the sixteen week period, there was found to be considerable leakage between anode and cathode and upon disassembly of the cell, numerous holes were found in region 15 adjacent flange 30. From the size and shape of the holes which were then analyzed, it was determined that chemical attack had caused the holes.

EXAMPLE 2

The same procedure as in the Comparison Example is followed, except this time about 50 one-eighth inch perforations are made in the upper portion of inner lip 37 of flange 30. Note that inner lip 27 is rectangular as is flange 30 and that these holes are placed in the upper portion or top of the rectangle. The casing is run for 16 weeks and then disassembled. No holes are found in transition region 15 during the sixteen week period by the casing.

EXAMPLE 3

A casing of the type illustrated in FIGS. 1–3 was fabricated starting with a sheet of a perfluorosulfonic acid membrane material (E. I. DuPont de Nemours' NAFION® 391). NAFION® 391 is a composite film having a layer 1 mil thick of 1500 equivalent weight perfluorosulfonic acid resin bonded to a layer 4 mils thick of 1100 equivalent weight perfluorosulfonic acid resin with the film being laminated to a T-900G fabric of polytetrafluoroethylene. Along the top edge and bottom edges of this sheet, two strips of a second perfluorosulfonic acid membrane material (NAFION® 427) were heat sealed at a temperature of 260° C., a pressure of 30 Kg/cm$^2$ and a dwell time of 4.0 seconds, employing the heat sealing apparatus used in Example 1. The strips had been pre-cut to provide a tab adjacent to the end which would serve as the open end. The sheet was folded to form the closed end. The strips were then sealed together linearly along the top edge and along the bottom edge. The tab was then sealed to interconnect with the linear seals and at an angle of about 90° from the linear edge. These seals were made at the temperature and pressure employed above with a dwell time of 4.5 seconds. The casing fabricated with the border strips provided tabs of a material having superior mechanical stress properties to that used for the body of the casing. The casing is attached by assembly **27*a* as in FIG. 11 and support 50 is a foraminous titanium louvered mesh of identical material to anodes 51 and run for 16 weeks as in Examples 1 and 2 and then disassembled. No holes are found in transition region 15**.

What is claimed is:

1. In a diaphragm-type cell for the production of chlorine gas having an anode, a cathode, a cell housing defining an anode chamber about said anode and a cathode chamber about said cathode, a diaphragm separating said cathode chamber from said anode chamber, a chlorine outlet in fluid communication with said anode chamber and a clamp for attaching said diaphragm to said housing, said diaphragm being attached at its upper end by a clamp to and extending downwardly from said cell housing, the improvement comprising:

(a) a support member, projecting downwardly from and spaced inward from said cell housing, for loosely underlying and supporting at least a portion of said downwardly extending diaphragm, and (b) ventilation passageway means, separate from and in addition to said chlorine outlet and passing through said support member at a point lower than said chlorine outlet, for allowing liquid gas flow between said support member and said portion of said diaphragm so as to allow continual contact of said portion of said diaphragm with liquid.

2. The diaphragm-type cell improvement of claim 1 wherein:

(a) said cell housing has an outer wall;

(b) said chlorine outlet passes through an upper portion of said outer wall;

(c) said outer wall includes an inwardly projecting clamping flange for attachment of said diaphragm; and (d) said clamp is adapted to clamp said diaphragm to said clamping flange.

3. The diaphragm-type cell improvement of claim 2, wherein said passageway means includes portions of said clamping flange defining perforations through said clamping flange.

4. The diaphragm-type cell improvement of claim 3 wherein said clamping flange is a frame of T-shaped cross-section with the base of the T lying attached to said housing and said support member is an inner lip of said clamping flange.

5. The diaphragm-type cell improvement of claim 4 wherein said passageway means portions of said lower lip pass through said lower lip.

6. The diaphragm-type cell improvement of claim 2 wherein said support member is made of titanium.

7. The diaphragm-type cell improvement of claim 2 wherein said support member is a foraminous plate lying parallel to said outer wall and said passageways are openings defined by portions of said foraminous plate.

8. The diaphragm-type cell improvement of claim 7 wherein said clamping flange is of L-shaped vertical cross-section with the base of the L being horizontal and attached at its outer end to said vertical wall.

9. The diaphragm-type cell improvement of claim 8 wherein said support member is downwardly spaced from said horizontal base of said clamping flange so as to define a gas passageway between said horizontal base and said support member.

10. The diaphragm-type cell improvement of claim 9 wherein said support member is made of titanium.

11. The diaphragm-type cell improvement of claim 9 wherein said support member is in electrical contact with a source of current so as to serve as a gas-evolving electrode, so as to make electrolytic use of said portion of said diaphragm.

12. The diaphragm-type cell improvement of claim 1 wherein said cell includes an electrode attached to said cell housing, and said support member is attached to and forms an upward projection from said electrode.

13. The diaphragm-type cell improvement of claim 1 wherein said catholyte chamber is at a higher pressure than said anode chamber and said support member underlies a side of said portion of said diaphragm towards said anode chamber whereby said portion of said diaphragm is forced against said support member.

14. The diaphragm-type cell improvement of claim 13 wherein said support member is made of the same material as said anode.

* * * * *